US007259508B2

(12) United States Patent
Witmer

(10) Patent No.: US 7,259,508 B2
(45) Date of Patent: Aug. 21, 2007

(54) MINI PLASMA DISPLAY

(76) Inventor: Warner H. Witmer, 306 Vista Dr., Phoenixville, PA (US) 19460

( * ) Notice: Subject to any disclaimer, the term of this patent is extended or adjusted under 35 U.S.C. 154(b) by 940 days.

(21) Appl. No.: 10/664,701

(22) Filed: Sep. 17, 2003

(65) Prior Publication Data

US 2005/0110419 A1 May 26, 2005

Related U.S. Application Data

(63) Continuation of application No. 09/630,089, filed on Aug. 1, 2000, now abandoned.

(51) Int. Cl.
*H01J 29/10* (2006.01)

(52) U.S. Cl. ..... 313/475

(58) Field of Classification Search ..... 385/17, 385/92, 94; 345/37, 41–43, 52, 55, 60, 63, 345/68, 71, 90; 315/169.1–169; 313/582–583, 313/631, 231; 348/14.07, 23, 93
See application file for complete search history.

(56) References Cited

U.S. PATENT DOCUMENTS 5,777,436 A * 7/1998 Lepselter ..... 313/582
5,962,975 A * 10/1999 Lepselter ..... 313/586
5,990,620 A * 11/1999 Lepselter ..... 313/585
6,072,273 A * 6/2000 Schoenbach et al. ..... 313/491

* cited by examiner

*Primary Examiner*—Shih-Chao Chen
*Assistant Examiner*—Minh Dieu A

(57) ABSTRACT

A flat display panel (MPDP) of the emissive plasma pixel element type for scanned television image reproduction is disclosed yielding bright, efficient and rugged displays for TV applications by use of MEMS and VLSI technology for fabrication. The invention takes a commplete system approach towards designing a high efficiency television display of the mini type for portable applications. A main objective of the present invention is to overcome problems inherent in X-Y matrix scanning of the picture elements in a flat display screen. A simplified addressing method eliminates the need for conventional X-Y matrix addressing of 1200 conductors. By means of the invention a gaseous electric discharge causes a visible light pixel to move progressively and recurrently along a series of adjacent electrodes by application of voltage impulses so as to achieve interlaced scanning. Improved construction technology to achieve very small pixel elements is a feature of the inventive struture. This is particularly advantegeous for HDTV applications where pixel sizes need to be small (20 urn) for a MPDP. Another major advantage of the contruction is that sealed cavities allows morre than one atmosphere gas pressure providing substatially improved light emission. This significantly improves the brightness of MPDP displays and enables improved projection displays as well a useful scanned high intensity micro-lamp rear lighting illumination for conventional LED flat screen display device.

14 Claims, 6 Drawing Sheets

Prior Art Waveforms

MINI PLASMA DISPLAY

This is a continuation of application Ser. No. 09/630,089, filed Aug. 1, 2000 now abandoned.

CROSS-REFERENCE TO RELATED APPLICATION

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates to display devices of the gas discharge type, generally classified under 315/169.4 of the U.S. Patent Classification System and light sources under H01J61/96 of IPC. In particular, the inventive concept concerns replacing conventional matrix addressing of the glow discharge pixels in gas plasma display panels with electrical pulse transfer of the localized glow discharge along a recurring path with the use of MEMS (Micro Electro Mechanical Systems) and VLSI (Very Large Scale Integration) technology for fabrication. By the scheme greatly simplified pixel addressing for television interlaced scanning is disclosed for a mini plasma display including low fabrication cost achieved by the advantages of MEMS and integrated circuit process technology.

2. Description of the Prior Art

Television Technology

In order for a flat screen to be useful for television it must be able to reproduce the functions of interlaced scanning of the conventional cathode ray tube. One main object of the invention is to duplicate the interlaced scanning requirements for television in a flat screen gas discharge display without the need for separately addressing each of the 1225 horizontal and vertical lines of a conventional matrix display. Another main object is to achieve low cost construction for a plasma screen of the miniature type by use of MEMS and integrated circuit fabrication technology The invention disclosed must meet the following essential technical criteria for interlaced TV scanning:

The standard picture repetition rate is 30 frames per second to accommodate eye-brain persistence. Interlaced scanning of the CRT electron beam means that first the odd-numbered lines, namely, 1, 3, 5, 7, etc., and then the even-numbered lines, 2, 4, 6, 8, 10, etc. are traced. Accordingly, two fields constitute one frame or a field repetition rate of 60 fields per second. Since 525 horizontal lines is the US standard for television reception and the standard aspect ratio of picture width to height is 4 to 3, and if the spacing between the elements along a horizontal line is the same as that in a vertical direction, then the theoretical maximum number of elements along a horizontal line is 525×4/3, or 700. Since the total number of elements in a picture is equal to the product of the number of horizontal and vertical elements, the theoretical maximum pixel density is 525×700, or 367,500 pixels.

In order to produce a clear steady picture, the scanning operation must satisfy the following requirements: (1) Each frame must be divided into two fields, (2) the rate of forward travel of a horizontal line must be linear, (3) the return trace of a horizontal line must be at a much higher speed than the active trace and should be blanked out, (4) the length of each horizontal line must be the same, (5) the rate of vertical movement of the beam must also be linear, (6) the vertical return trace of the beam must be at much higher speed than the downward motion and should be blanked out, (7) the amount of vertical movement must be the same for each field and each frame, (8) the width of the beam should be equal to the width of one horizontal line, (9) the space between adjacent lines in any field should be equal to the thickness of one line, (10) the first field should trace the odd-numbered lines as 1, 3, 5, etc., until 262½ lines of the 525-line raster are completed, (11) the second field must trace its 262½ lines (2, 4, 6, etc.) in the spaces midway between the lines of the first field, (12) each odd-numbered field must fall in the same position as the preceding odd-numbered field, (13) each even-numbered field must fall in the same position as the preceding even-numbered field.

Transmission of a special synchronizing signal from the television transmitter controls the instant of starting and the length of scanning time for each horizontal line at the picture tube of the receiver and also the vertical motion of the scanning beam. At the end of each horizontal line scan a blanking pulse is provided called the horizontal blanking pulse. The duration of this pulse is 1.27 μsec before the end of the active trace of a line. The sum of both the active and retrace portions for the 525-line system is 63.5 μsec. The duration of the blanking pulses between horizontal lines is approximately 10 μsec. The pulse provided at the end of each field is called the vertical blanking pulse. The duration of the blanking pulses between successive fields is kept within the limits of 1167 and 1333 μsec.

The following functions must be performed during the blanking period associated with the vertical synchronizing pulse: (1) blanking out for a period of 20 to 22 horizontal lines; (2) returning the 'beam' from the bottom to the top of the raster; (3) returning the 'beam' to either the start of a line or the center of a line so that it will begin the succeeding field at the position required to produce interlaced scanning; (4) continuing the operation of the horizontal oscillator at its proper frequency during this blanking period so that the scanning beam will be at its required position when the blanking pulse ends.

For good television pictures, a video signal with a range of 30 to 4,500,000 cps is desired. The lower frequency values are required when a scene of uniform density or shading is to be transmitted, and the higher frequency values are required for transmission of scenes having a large number of areas of alternately light and dark shading.

X-Y Matrix Plasma Displays

The scanning method presently used in state-of-the-art flat screen displays is matrix or X-Y addressing. Gas discharge lamps operate by passing a high voltage through a low-pressure gas to generate ultraviolet light which then strikes associated phosphors. As these phosphors return to their natural state they emit red, green or blue visible light. Thus they operate like fluorescent lamps, with each pixel the equivalent of a tiny colored bulb. Since plasma display panels (PDPs) are emissive and use phosphor, like CRTs, they have excellent viewing angle and color performance. Plasma display panels (PDPs) are numerous tiny gas discharge lamps of the type described which are individually turned on by use of an X-Y matrix of electrodes. The intersection of a row and column of electrodes at the tiny gas discharge lamp defines a pixel, constituting a tiny source of light. When a voltage is applied to orthogonal electrodes, the gas in the channel becomes ionized and conducts current where the electrodes cross. Within the pixel a gas such as Xenon is converted to plasma form by the electrical voltage applied where the electrodes intersect. The plasma generally emits ultraviolet light activating associated phosphors to cause localized light emission.

Matrix-addressed plasma displays are generally fabricated by forming rows of channels etched into a glass substrate, which are filled with xenon, neon, helium, or combinations of inert gas, then sealed. The gas channels making up the rows of the array are fitted with two electrodes. The electrodes along the rows provide a priming voltage which provides partially ionized gas while perpendicular to the gas channel rows are electrode strips that supply the analog pixel data. Because ionized gas is needed to complete the charging circuit, the column data voltages only have an effect on the pixels in a row for which a plasma channel is partially ionized. Consequently, by electrical activation of separate rows and columns of conductors a picture element is defined at the 'cross-over'. A matrix plasma display, therefore, operates by addressing a large number of tiny discrete gas discharges in sequence to correspond with the requirements of television scanning. By charging the channel rows in sequence and sending data signals during the time the gas is switched on, the display is addressed row by row. This cumbersome addressing method results in considerable switching complexity.

Another problem with conventional plasma screens is that they have traditionally suffered from low contrast. This is caused by the need to 'prime' the cells, applying a constant low voltage to each pixel across a row. Without this priming, plasma cells would suffer the same poor response time of household fluorescent tubes, making them impractical. The pixels, which really should be switched off for proper image contrast, emit some light thus resulting in dull contrast. Kanazawa, et al., describe apparatus attempting to eliminate the reduced contrast and for driving the orthogonal electrodes required of a gas discharge matrix display in U.S. Pat. No. 6,034,482. Tsutomu et al., describe a driving system for matrix operated plasma displays in U.S. Pat. No. 5,995,069. Buzak in U.S. Pat. No. 5,077,553 describes a synchronously addressed driving system for matrix operated plasma display of the X-Y type whereby the orthogonal electrodes are addressed using buffer memory, sample and hold, CCD, or other data drivers schemes.

Since conventional TV consists of 525 horizontal lines at a 4×3 aspect ratio, about 367,500 picture elements must be activated in sequence by matrix addressing. This means that separate connections must be made to 525 rows and 700 columns in the display and their activation must be in accordance with TV scanning requirements. Consequently, X-Y matrix systems are limited by the picture element resolution required for good picture reproduction and by the number of connections required to synchronize addressing 1225 horizontal and vertical connectors. It would be desirable to provide elimination of the considerably complex driving circuitry of matrix driven plasma displays while achieving the interlaced scanning requirements of television. Baasch describes in U.S. Pat. No. 3,681,754 a moving sign plasma display device using multidirectional transfer of the plasma glow by means such as magnetoplasmadynamic propulsion. Gas discharge stepping devices utilizing the bistable nature of the ionization properties of gas discharges are described in U.S. Pat. No. 2,443,407 by Wales wherein 3Ø devices of this type allow transfer of the glow discharge electrode-to-electrode. Townsend in U.S. Pat. No. 2,575,370 describes a special electrode configuration that allows 2Ø operation whereby only two supply lines are required for glow transfer. Witmer describes use of these stepping mechanisms for addressing a flat screen gas discharge display in U.S. Pat. No. 3,532,809.

Liquid crystal displays (LCDD) are another type of flat display. Unlike gas discharge displays, devices of the LCD type have no inherent illumination and consequently they must be backlit. Usually the LCD panels are backlit by fluorescent tubes that snake through the back of the unit and this sometimes results in brighter lines in some parts of the display than others. It would be desirable if the problem of uniform bright backlighting could be solved with preferably a scanning pixel light source.

TV Recurring Raster Patterns

It is well known in the TV art that standards for TV reception and transmission require what is called interlaced scanning by a recurring raster pattern for presentation of a TV image. What this means essentially is that a television display must duplicate the original cathode ray tube scanning method wherein an electron beam scans the screen of the picture tube and the brilliance of the spot produced varies in accordance with the amplitude of the picture-information signal voltage being applied to the control grid of the CRT. If the scanning action at the picture tube in the receiver is in synchronism with the scanning action at the camera tube of the transmitter then the original scene at the transmitter will be reproduced at the receiver. These standard TV requirements are detailed in such books as Essentials of Television, McGraw-Hill, pgs. 20-30 and many others so they will not be detailed here. Raster scanning, as it is called in the industry, requires that any proposed display for TV must be compatible with these requirements, including matrix addressing as described above.

A feature of the invention herein described is that it does not use matrix addressing to meet the scan requirements of TV standards but transfers a gas discharge along gas cavity pixel elements row by row to meet TV raster scan requirements in a manner similar to the scanning method used in the original CRTs.

Microfabrication Technology—Preferential or Selective Etching

As well known in the Microfabrication art (See for example, Fundamentals of Microfabrication, Mark Madow, CRC Press, 2002; pgs 207-280) the fact that silicon can be made crystalline is of extreme usefulness. The art of micromachining is dependent upon crystal plane differences whereby anisotropic etchants "machine," desired structures in crystalline materials by etching much faster in one crystal plane direction than another. The different crystal planes of semiconductor crystalline materials like silicon have different mechanical and chemical properties for one reason because of differing atomic density. Because of these different properties an important useful characteristic of crystalline silicon is that special etches can be used, called preferential or selective etches (also called structural etches), that exhibit anisotropy. That is, the chosen etch can be made to more quickly etch silicon (or other crystalline semiconductors) in one crystalline direction than the other thereby producing significant difference in etch rate and thus allowing specific desired structures. When carried out properly, anisotropic etching results in geometric shapes bounded by the slowest etching crystallographic planes providing perfectly defined structures. A wide variety of etchants have been used for anisotropic etching of silicon, including alkaline aqueous solutions of KOH, NaOH, LiOH, CsOH, RbOH, NH, OH, and quaternary ammonium hydroxides, with the possible addition of alcohol. Alkaline organics such as ethylenediamine, choline (trimethyl-2-hydroxyethyl ammonium hydroxide), hydrazine and sodium silicates with additives such as pyrocatechol and pyrazine are employed as well. For example, KOH solutions when used to etch <100> crystalline silicon quickly etch the atomic planes in the [100] direction but very slowly etch in the much denser [111] direction resulting in a cavity shaped with precisely defined sides of 54.7 degree slope. Because the cavity is bottomed by crystal planes in the [111] direction the cavity bottom is very slowly etched and thus flat, specular, and mirror smooth. Since lateral mask geometries on planar photoengraved substrates can be controlled with an accuracy and reproducibility of 0.5 μm or better this coupled with the anisotropic nature of preferential etchants allows this accuracy to be translated into control of the vertical etch profile for a silicon cavity. Features of the microfabrication art are used in combination in the present invention to provide the numerous very precisely defined gas cavities required for a miniature plasma display.

Another very important fabrication method used in combination in the present invention to provide numerous very precisely defined gas cavities for a plasma display is MEMS etch-stop technology. The MEMS (Micro Electro Mechanical Systems) art (see The MEMS Handbook, Mohammad Gad-el-Hak, CRC Press, 2002, pgs. 72-73) uses etch-stop techniques based on the fact that anisotropic etchants, especially EDP (Ethylene Diamine Pyrocatechnol), very slowly attack boron-doped (p+) silicon layers compared to non-doped boron layers. Experiments show that the decrease in etch rate is nearly independent of the crystallographic orientation and the etch rate is proportional to the inverse fourth power of the boron concentration. Atomically, the etch rate observed within the etch stop region is determined by the number of electrons available in the conduction band at the silicon surface. This number is assumed to be inversely proportional to the number of holes and thus the boron concentration. It is known in the microfabrication art that the concentration of boron and the depth of a boron layer can be very closely controlled in silicon by use of such well known techniques as diffusion, epitaxial layering, or Si-to-Si bonding. For example, silicon of N-type doping or of light boron doping can be of accurate specific thickness atop an etch-stop layer of silicon of high boron doping. Thereby the top layer of silicon can be etched relatively quickly down to the boron doped layer whereat the etch rate greatly decreases or effectively stops providing a cavity of specular bottom. These desirable features are used in combination in the present invention to provide numerous very precisely defined gas cavities for a plasma display.

The invention herein uses in combination these MEMS and microfabrication techniques such as preferential etch and etch-stop methods to precisely determine the depth of a gas containment cavity whereby extremely accurate gas cavities can be uniformly fabricated. In combination such MEMS technology as anodic bonding of glass to silicon, preferential etching, etch-stop techniques, and preferential tungsten deposition, known in the MEMS art, are used in combination in the present disclosure to provide advantageous construction of a miniature plasma display device.

OBJECTS OF THE INVENTION

In view of the problems mentioned above it is a primary object of the invention to provide a gas discharge display system of simplified address circuitry.

It is another object of the invention to provide a multiplicity of pixel elements of very small size.

It is another object of the invention to provide small-sized pixel elements of hollow cathode configuration.

It is another object of the invention to provide a method for sequentially activating pixel elements of a gas plasma display system by means of applied electrical pulses so as to duplicate the requirements of interlaced scanning of television.

A further object of the invention is provide innovative construction of a mini-plasma display using MEMS and integrated circuit process technology which are particularly suited to very high component density requirements.

Another object of the invention is to provide a scanning type reproduction system wherein a recurring gas discharge is precisely controlled as to pixel position, scan timing, and linearity.

Another object of the invention is to provide a scanning light source for such uses as LCD displays requiring backlighting.

A further object of the invention is an innovative method allowing sealing each individual pixel element for considerable faceplate strength.

A further object of the invention is an innovative method allowing sealing each individual gas discharge cavity to allow increased gas pressure for improved pixel light luminous efficiency.

Another object of the invention is an innovative method to allow viewing a PDP with illuminated pixel elements unobstructed by electrode elements.

These and further objects will appear from the following description of an embodiment of the invention.

BRIEF SUMMARY OF THE INVENTION

In accordance with the present invention, an image reproduction system is constructed as an extremely compact structure including a multiplicity of gas cavities individually sealed and bottomed by a glass faceplate in its forward portion. The gaseous discharge stepping array wherein a glow discharge is caused to transfer along a predetermined path by application of voltage impulses is constructed in a silicon plate bonded to the glass faceplate. The rearmost portion of the display consists of an electrically insulative enclosure plate. By means of the invention a gaseous electric discharge causing a visible light pixel is moved progressively and recurrently along a series of adjacent electrodes in predetermined way so as to achieve interlaced scanning. An overall objective of the present invention is to overcome problems inherent in scanning the picture elements in a flat display screen by means of an inventive structure and by improved construction technology.

BRIEF DESCRIPTION OF THE SEVERAL VIEWS OF THE DRAWINGS

The above objects and the principles of operation of the device will be better understood by reference to the following detailed description and illustrated by the drawings, wherein.

DETAILED DESCRIPTION OF THE INVENTION

Figure 1:
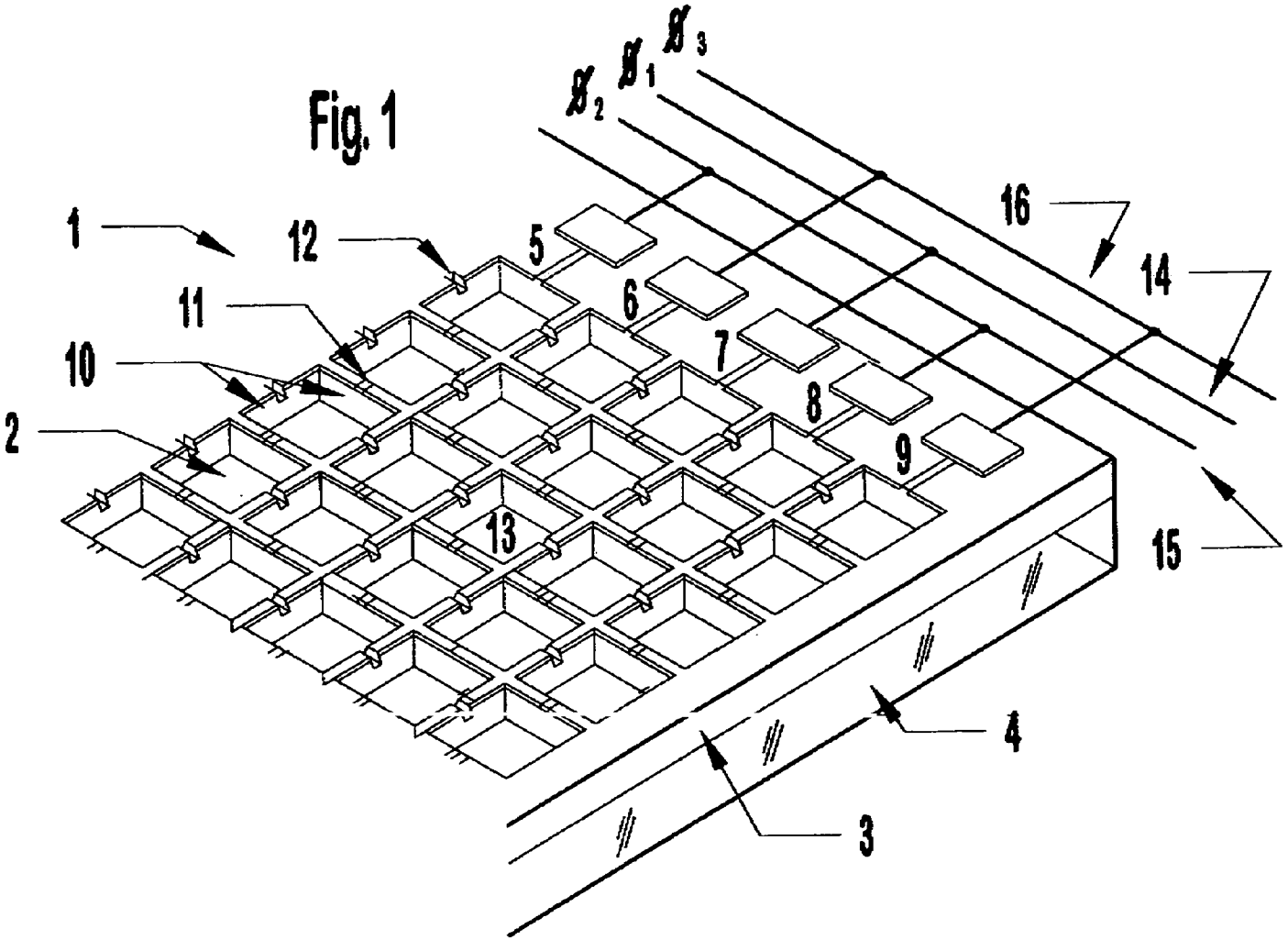
FIG. 1 is a diagrammatic illustration showing a three-phase electrode configuration of the gas discharge transfer mechanism with gas cavities formed in a semiconductor material.

Referring now to FIG. 1, a portion of an array 1 of gas discharge pixel cavities 2, are shown micromachined into silicon crystal wafer 3 bonded to glass faceplate 4. The cavities 2 are etched through the silicon wafer 3 so as to be bottomed by the faceplate 4. Bonding pads 5, 6, 7, 8, 9 each lead to columnar electrodes that include sidewall electrode portions 10 within the pixel cavities 2 interconnected in a columnar or vertical direction by connecting strips 11. Electrical lines 14, 15, 16, respectively, called Ø1, Ø2, Ø3 supply lines, are selectively connected to the bonding pads 5, 6, 7, 8, 9, etc. Each gas discharge pixel cavity 2 contains two ionization discharge slots 12 along the row, or horizontal, direction only.

Figure 2:
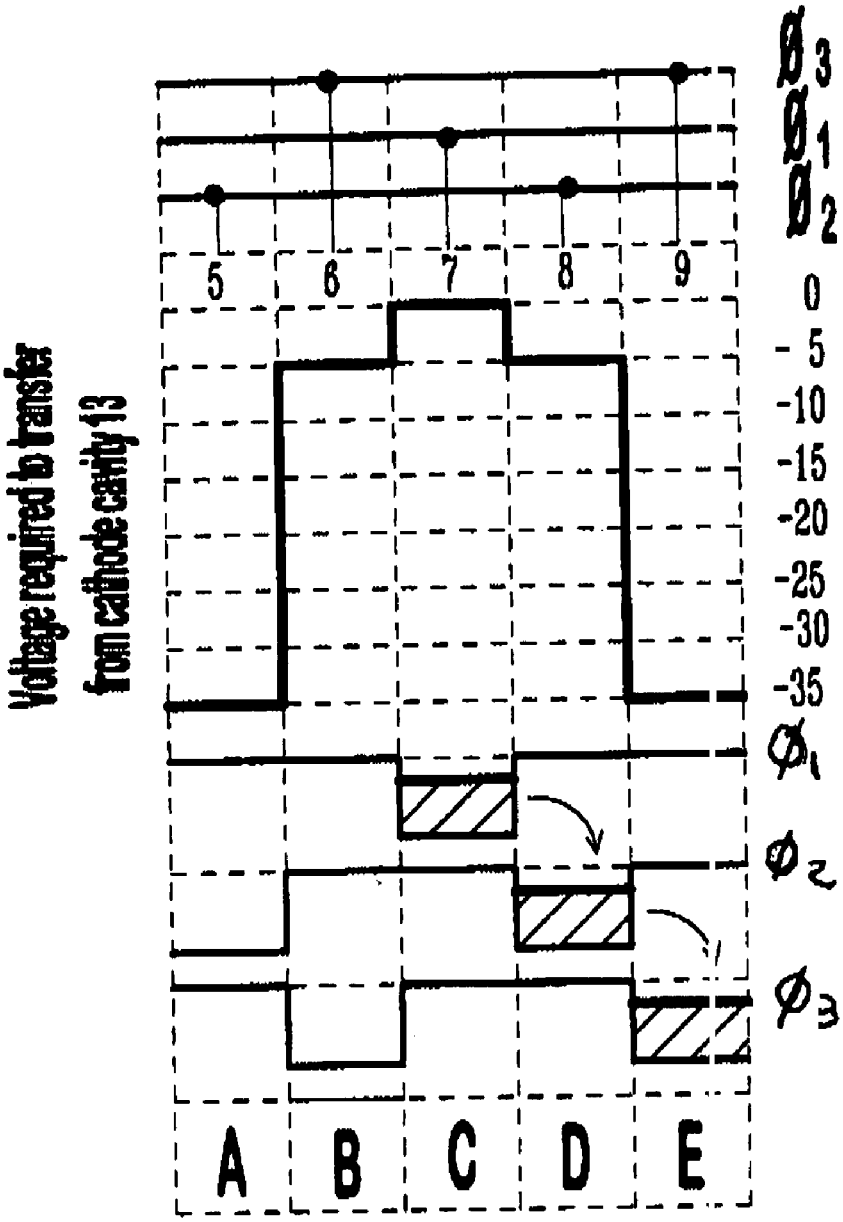
FIG. 2 is a graph of the voltage waves applied to the 3-phase structure to achieve gas discharge transfer

Referring now to FIG. 2, showing the applied pulse timing diagram, assume a glow discharge sustains at cathode element 13 (column 7 of FIG. 1). It can be seen in the upper portion of FIG. 2 that the glow discharge can be transferred to either the left or right electrodes adjacent cathode cavity 13, under columnar electrode 7, by application of about 4.5 volts to either adjacent columnar electrodes whereas about 35 volts is required to transfer the glow discharge to cathode elements two cathode elements away when pressurized hydrogen gas filling is used. Once the discharge reaches the adjacent cathode it will remain at that cathode until the next succeeding pulse thereby closing the circuit from that cathode through the load resistor. It will be understood that the negative pulse and the load resistor should be correlated so that when the discharge is shifted from one electrode cavity to another the increased voltage drop in the load resistor is sufficient to cause the voltage to fall below the sustaining value. Thereby the discharge at the succeeding cathode from which the discharge has been transferred, will be extinguished.

At the lower portion of FIG. 2 there is shown the clock timing diagram for three-phase transfer wherein the horizontal axis is time and the vertical axis is the amplitude of the signal applied to the phases, herein conveniently shown as square wave pulses. The command signals applied to the cathode electrode columns are sequential and are called clocks. Each phase is driven by a distinct clock signal. All the clocks together form a clock timing sequence and the relative phasing of the clocks must be carefully adjusted to optimize elements such as the gas discharge transfer speed. Normally the clocks of the different phases cross at intermediary levels to improve the flow of ions initiating glow transfer from one electrode to another. There are a number of transfer methods, specific for a given type of gas discharge stepping device, and they generally differ by the number of phases involved. FIG. 2 diagrams the voltage pulses applied to the three-phase glow discharge transfer system used to assure pixel light scanning in the desired direction.

As shown at the bottom of FIG. 2, a pulse timing diagram is illustrated, showing timing periods A, B, C, D, E. During time period C electrode column 7, connected to the Ø1 line, has a more negative potential (clocked 'high') than adjacent electrode column 8 (connected to Ø2 line, clocked 'low') and also electrode 6 (connected to Ø3 line, clocked 'low'). During the clock time period D the Ø2 line is clocked 'high' while the Ø1 line and the Ø3 line are clocked 'low'. As a consequence the gas discharge transfers from electrode 13 to the adjacent right hand electrode along the row, under column electrode 8, connected to the Ø2 clock. The same type clocking operations cause further charge packet transfers by the application of this pulse timing mechanism. This transfers the ionized charge (shown cross-hatched in FIG. 2) from electrode-to-electrode in the right hand direction allowing pixel scanning without the requirement for separately addressing the X and Y lines in conventional matrix addressing. Thereby physical transfer of the light pixel is accomplished by means of applied electrical pulses only. No X-Y matrix of electrode elements is required. By this method the gas discharge, or light pixel, traverses a preferred path by application of voltage pulses only, in accord with a desired scan address system.

It has been found that the shape of the input pulses and the time between pulses are not critical. Sine wave form, rectangular and exponential pulses have been utilized successfully. However, because of the deionization time factor a minimum pulse length and a minimum period between pulses are required to prevent false operation. This may be understood from a consideration of ionization remaining in the vicinity of the cathode. If the transfer pulse is released before deionization occurs in the gap between cathode 13 and the preceding cathode, the gas discharge may transfer upon cessation of the pulse from the cathode 13 back to the preceding cathode. The particular pulse length and deionization period required will be dependent, of course, upon the particular gas employed and the pressure thereof. The gas within the cavity may be neon at a pressure of 20 millimeters of mercury but other gases, such as for example, argon, krypton, helium, xenon, hydrogen, or mixtures of these may also be used. Neon at a pressure of 50 millimeters of mercury has been found satisfactory with sine wave pulses at frequencies up to 1300 cycles per second, which corresponds, to approximately 0.4 millisecond pulse duration. In experimental devices, wherein the gas was hydrogen at a pressure of 20 millimeters of mercury, operation at frequencies of the order of 60,000 cycles per second had been attained, corresponding to pulse lengths of approximately 8 microseconds. Even higher transfer rates are possible using shaped waveforms and trace amounts of radioactive gas such as Krypton.

Without the sustaining glow discharge in a cathode element an anode-to-cathode voltage of about 35 volts would be necessary, depending upon gas type, to effect transfer of the gas discharge to an adjacent cavity whereas only 4.5 volts or less is necessary to effect transfer electrode-to-electrode by application of the voltage pulses described. This is because the ions necessary for cathode glow initiation at the succeeding electrode are available at the ion slots 12 from the prior electrode glow discharge and the required ions for controlled initiation of the glow discharge is already accomplished. Since these slots are in the row direction the glow discharge cannot transfer in the column direction. Once the discharge reaches any cathode electrode it will remain at that cathode until the next succeeding pulse, closing the circuit from that cathode through the load resistor. Thus the preference feature whereby the discharge is stepped always in one direction in response to digital pulses applied to the sustaining cathode onto a preferred transfer cathode requires a relatively low voltage difference, about 4.5 V. About 35 volts is required for transfer to cathodes more than one cathode either side. The difference, about 30 volts, is the counting margin and is dependent upon the cathode geometry, the gas filling, and also upon the anode current. The general relationship between the counting margin and the anode current shows that there is a current for which the gas discharge transfer counting margin is the maximum or optimum.

It is to be noted that the system for transferring the glow discharge will operate equally well using a common cathode and three multiple anodes. Indeed, the same electrode geometry will operate when excitation is supplied by alternating potentials. Within the principle of the gas discharge transfer device, any number of sequentially alternate multiple electrodes above three may be used for special applications where it is desired to separate the possible points of discharge by a greater distance than is possible with three sets of discharge points. Preferential direction of gas discharge pixel transfer is determined by the direction of descending potential applied to the intervening electrodes, since the higher of the two electrode potentials adjacent to a terminating discharge will capture it, providing of course, a symmetrical surface condition and geometry obtains. The sequential transfer of the gas discharge pixel between the three multiple electrodes may be made by a pulse generator or commutator, or by electronic circuit employing means well known in the art. Two phase transfer of the gas discharge is also possible as, for example, by means of providing electrode configurations favorable to asymmetric stability of the gas discharge preferential to one side of the electrode. A gas discharge stepping device of the two-phase type is described in U.S. Pat. No. 2,575,370 by Townsend.

Figure 3:
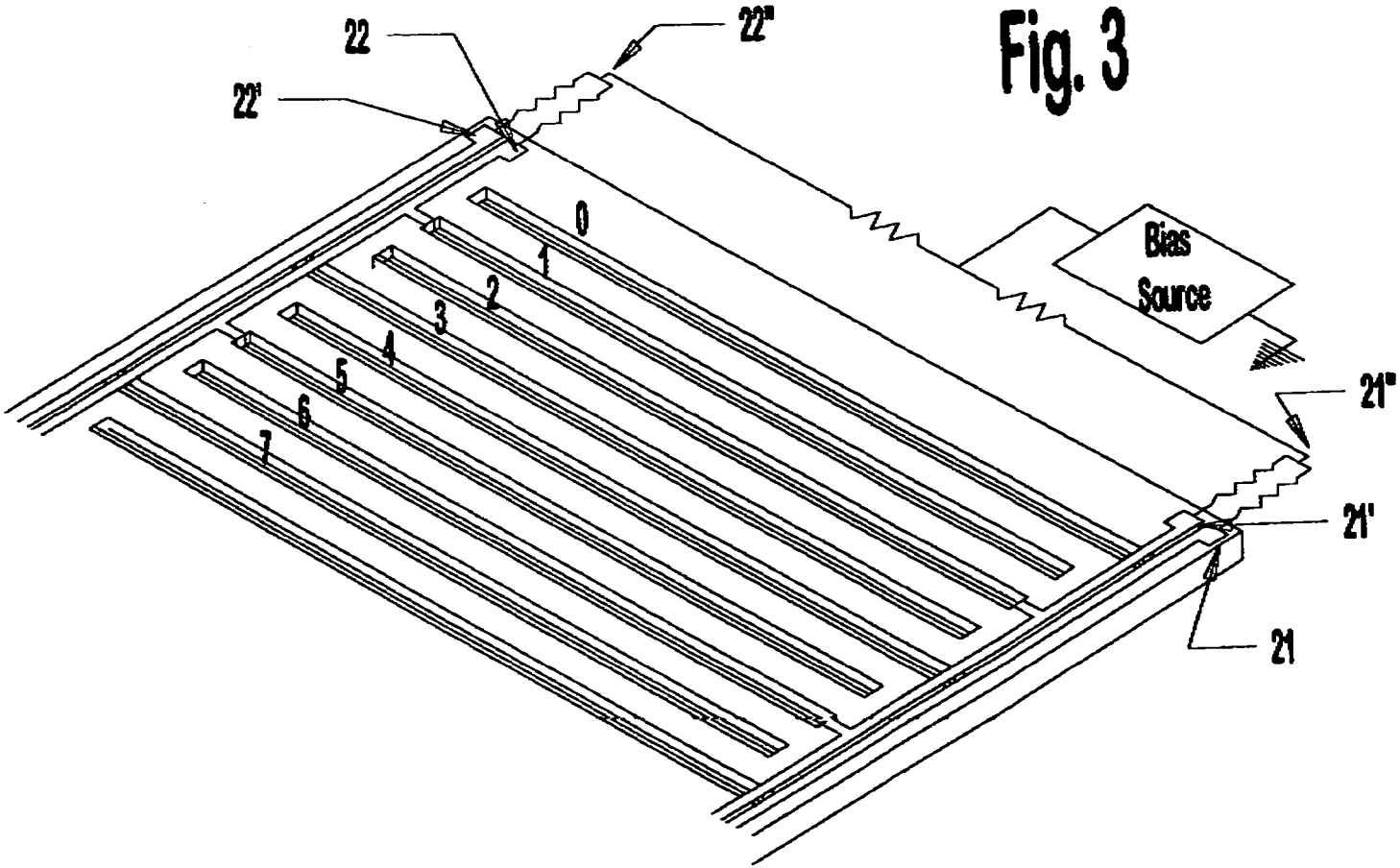
FIG. 3 is a diagram of the backplate of the present invention showing spaced anode elements.

FIG. 3 diagrammatically shows the backplate of the plasma display depicting anode row electrodes. The back cover plate must be of sufficient structural integrity to withstand the internal gas pressure and is preferably a ceramic plate holding the recessed metal anode elements. The metallized anode stripe electrodes on the back faceplate are recessed and configured so as to align with the ionization discharge slots 12 along each row of cavities 2 of the array 1 shown in FIG. 1, when the back coverplate is placed in aligned contact with the surface of the silicon wafer portion of the front plate. Since the row electrodes are recessed and because the cathode electrode portions 10 of the columnar conductors within the cavities 2 do not extend to the interface surface, the column electrode conductors are thus electrically insulated from the anode row electrode conductors. Subsequently, the back cover plate is hermetically sealed to the frontplate, which includes the silicon wafer, in a peripheral manner while suitable gas is introduced within the cavities of the array 1.

When a potential in excess of the breakdown voltage is applied between any columnar cathode electrode and a chosen row anode electrode a visible discharge will take place at the intersection. Assuming a suitable anode series load resistor (FIG.3), only the chosen electrode cavity will be activated because of the fact that as soon as a discharge is established its discharge current passing through the series load resistor causes a drop in the cathode-to-anode potential and this lowered potential is inadequate to initiate a second discharge at any other cathode pixel element 2 in the array 1. It is this mutually exclusive gas discharge feature, the drop in breakdown voltage to a lower sustaining voltage, that is the mnemonic characteristic of the system. This mutually exclusive gas discharge feature wherein one only of the pixel elements is illuminated is one of the basic features of the light pixel scanning array system.

Assume a glow discharge at sustaining voltage obtains at pixel element 13 (FIG.1), in a suitable gas contained in the cavity, by the application of potential difference between column electrode 7 and the associated row anode stripe electrode (FIG.3). Because of the presence of the ion slots 12 the adjacent gas in the cavities in the row to the left and to the right of the glow discharge cavity 13 sets up preferential conditions for establishment of the gas discharge in either of these two cavities. By use of three sets of electrodes this ambiguity of transfer direction can be eliminated by directed preference of transfer of the glow discharge as follows: each of three sets of columnar transfer electrodes 5, 8, etc. and columnar electrodes 6, 9 etc. are shown interconnected in common. A group of columnar electrodes with a common electric link, or interconnection, is called a phase (Ø). For this 3Ø gas discharge transfer the connections for the Ø1, Ø2, Ø3 supply lines are shown in FIG. 1, wherein recurring electrical pulses are selectively applied to these lines. Referring now also to FIG. 2, showing the timing of the recurring electrical pulses, one set of electrodes, the Ø1 electrodes in this example, are traditionally called 'rest' electrodes, while the Ø2 and Ø3 electrodes are called 'transfer' electrodes although in the display invention of the present disclosure the glow discharge 'rest' time is generally the same for all electrodes.

Referring again to FIGS. 1 and 2, assume a glow discharge obtains at pixel element 13 by application of negative voltage to the columnar cathode element 7 and suitable positive potential is maintained at the associated anode row strip wherein the sustaining current is controlled by a load resistor. Because of the ionization slots 12 to the left and right sides of cavity 13 some ionized gas is available to the cavities at the immediate left and the immediate right of cavity 13. Because of the ionized gas available these associated cavities are preconditioned and require a lowered breakdown voltage compared to all other cavities of the row or other pixel elements of the array 1. If increased negative potential is applied to all the Ø2 electrodes 15, which includes electrode columns 5, and 8, etc., and if decreased negative potential is applied to the all the Ø1 rest electrodes, which includes column 7, while at the same time decreased negative potential is applied to all the Ø3 electrodes, which includes electrode columns 6 and 9, then the glow discharge at the particular pixel element 13 will transfer to the gas discharge cavity immediately to the right of cavity 13. Because of the closer proximity of the cavity immediately to the right of cavity 13, associated with column 8, as compared to the electrode cavity two places to the left, corresponding to columnar electrode 5, it can be seen that both proximity and the active ion slots provide for selection of the cavity to the right of 13 for glow transfer. Sequential applied voltage to the Ø1, Ø2, Ø3 supply lines affects subsequent transfers of the glow discharge to the right. Thus a gas discharge may be transferred using much simplified 3-phase pulse timing to effect transfer of a glow discharge along a predetermined path in predetermined time without the requirement for X-Y matrix addressing.

Referring again to FIG. 3 shows there is shown the backplate containing the row anodes which control the downward progression of the glow discharge. The horizontal anode conductors, recessed in the backplate to insulate them and to precision align them from the mosaic of cathodes comprise four sets of interconnected wires. The set of anode electrodes numbered 0, 4, 8—including every fourth anode electrode below—are connected to terminal 21 and are insulated from the set of anode wires numbered 2, 6—and every fourth anode wire-below connected to terminal 21'. Similarly, at the left end of the set the wires numbered 1, 5—and every fourth anode wire below of the set 22 are insulated from the anode wires 3, 7—and every fourth anode wire of the set—connected to terminal 22'.

Figure 4:
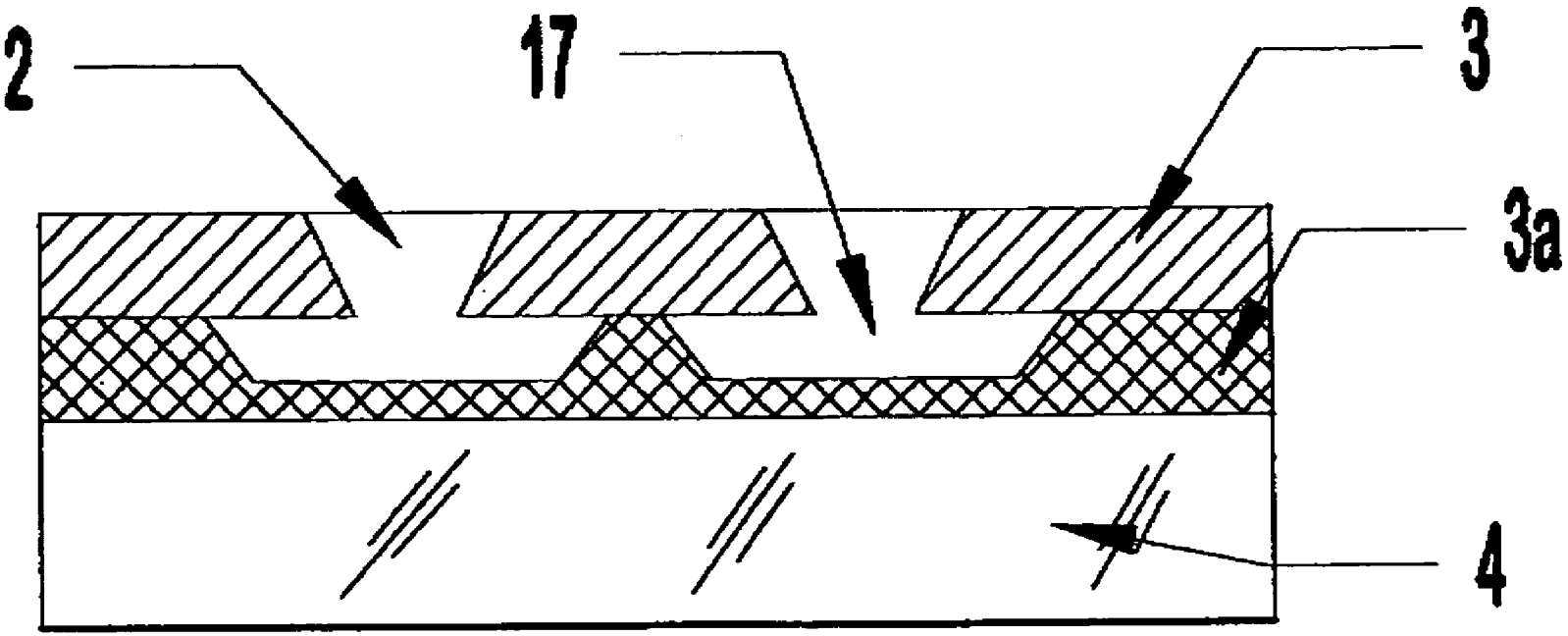
FIG. 4 is a cross-section of a cavity element showing hollow cathode configuration.

FIG. 4 shows a cross section of a representative gas cavity illustrating the device structure for achieving a preferred hollow cathode by the addition of silicon layer 3*a* of selected properties different from silicon layer 3. Cavities 2 are first etched in silicon layer 3 using micromachining technology as described in the books referenced. Then a different etch method is chosen to selectively form etch cavity 17 of desired enlarged or reduced extent in silicon layer 3*a* using preferential etching methods as described in the Description of Prior Art. Silicon layer 3*a* can be bonded, or diffused, or can be an epitaxial layer added to silicon wafer 3. Combined preferential etch methods and silicon layer properties, well known to the MEMS art, allows formation of the desired hollow cathode structure array.

Figure 5:
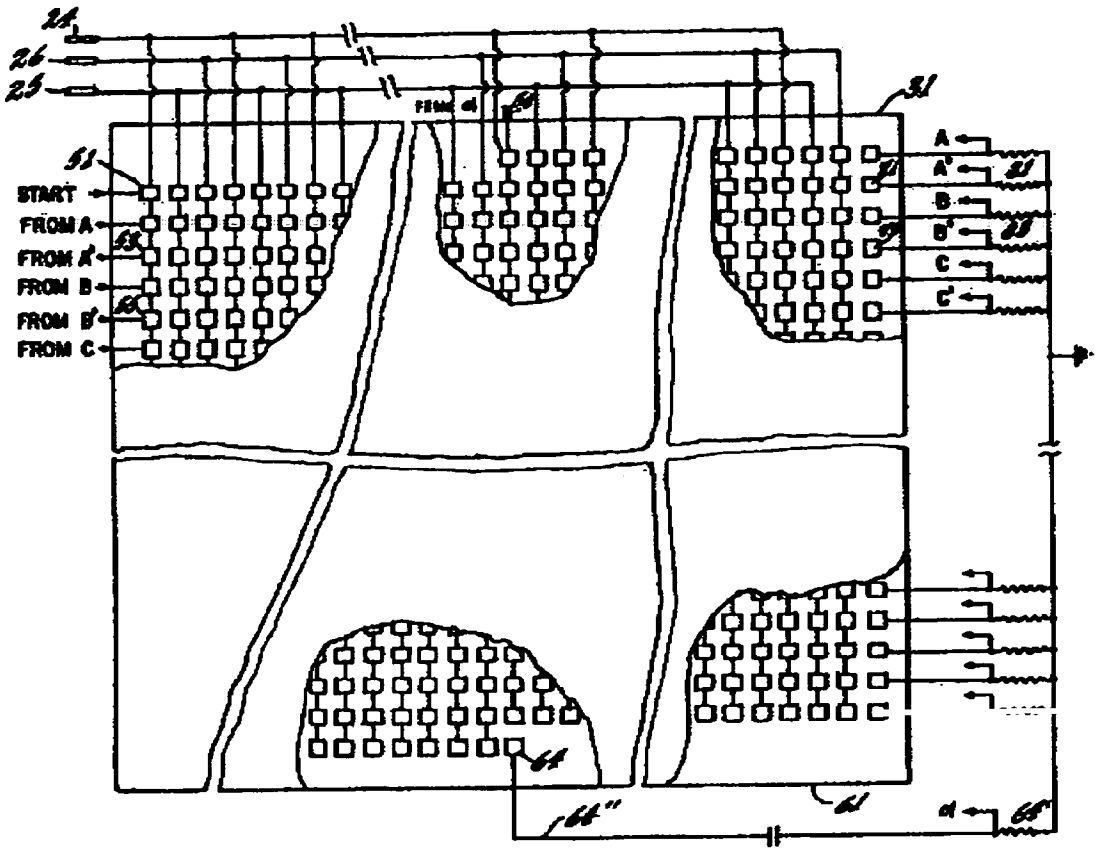
Fig. 5 Prior Art
FIG. 5 is a diagrammatic illustration of prior art mosaic of cathode elements of the present invention applied to a television receiver display.

FIG. 5 shows the array of cathode elements required for a flat panel display device as disclosed in prior art by Witmer (U.S. Pat. No. 3,532,809) wherein the key locations are shown for initiating pixel scanning requirements. A strong negative pulse is required to reset, or initiate the glow discharge at the beginning of a row. As indicated in FIG. 5 an array of cathodes are shown with the first, fourth, seventh, and additional column electrodes connected at intervals of three across the cathode array to source wire 24. Cathode columns of the second, fifth, eighth, and additional column electrodes at intervals of three across the cathode array 1 are interconnected by the source wire 25. The cathode columns of the third, sixth, ninth and further column electrodes at intervals of three across are interconnected by the source wire 26. Except for the right bottom and right vertical row, the remaining cathodes of the mosaic are interconnected as described.

FIG. 5 shows scanning of the glow discharge as required to commence at cathode 51 at the upper left corner of the mosaic, and proceed along the first full line (a substantially horizontal line) of cathodes to the upper right corner of the mosaic, i.e., to cathode 71. The glow discharge must then be transferred from the right-hand end of the first full line of cathodes to the left-hand end of the third full line of cathodes, i.e. to cathode 53. The electron discharge is then required to progress at the predetermined rate from the extreme left-hand cathode 53 to the extreme right-hand cathode 73 in the third full line, and to be transferred from that point immediately to the extreme left hand cathode 55 in the fifth full line, and so on. Upon progression of the electron gas discharge along the bottom half-line of cathodes to cathode 64, transfer is required to be made to the top of the device plasma display at 60 to begin the half-line top row scan, then the even-numbered full lines of cathodes, concluding with the arrival of the glow discharge at the extreme right-hand cathode of the last full line of cathodes, from which a transfer is again effectuated to the starting cathode 51 at the upper left corner of the mosaic.

Referring again to FIG. 5, electronic circuits (shown in FIG. 6 ) are provided for establishing an initial glow discharge between starting cathode 51 and row anode 1 (FIG. 3) through the gaseous medium contained in the display device. After transfer of the glow discharge is effected along anode row 1 by means of the stepping pulses applied to the column electrodes, scanning of the glow discharge from left to right along the cathodes adjacent wire 1 is accomplished. Rightmost cathode 71 in this row allows detection of the glow discharge which signals circuitry to initiate a glow discharge at cathode 53 to begin scanning the next even row (row 3 in this case, FIG.3 ). Further scanning of the even rows is repeated as described.

Figure 6:
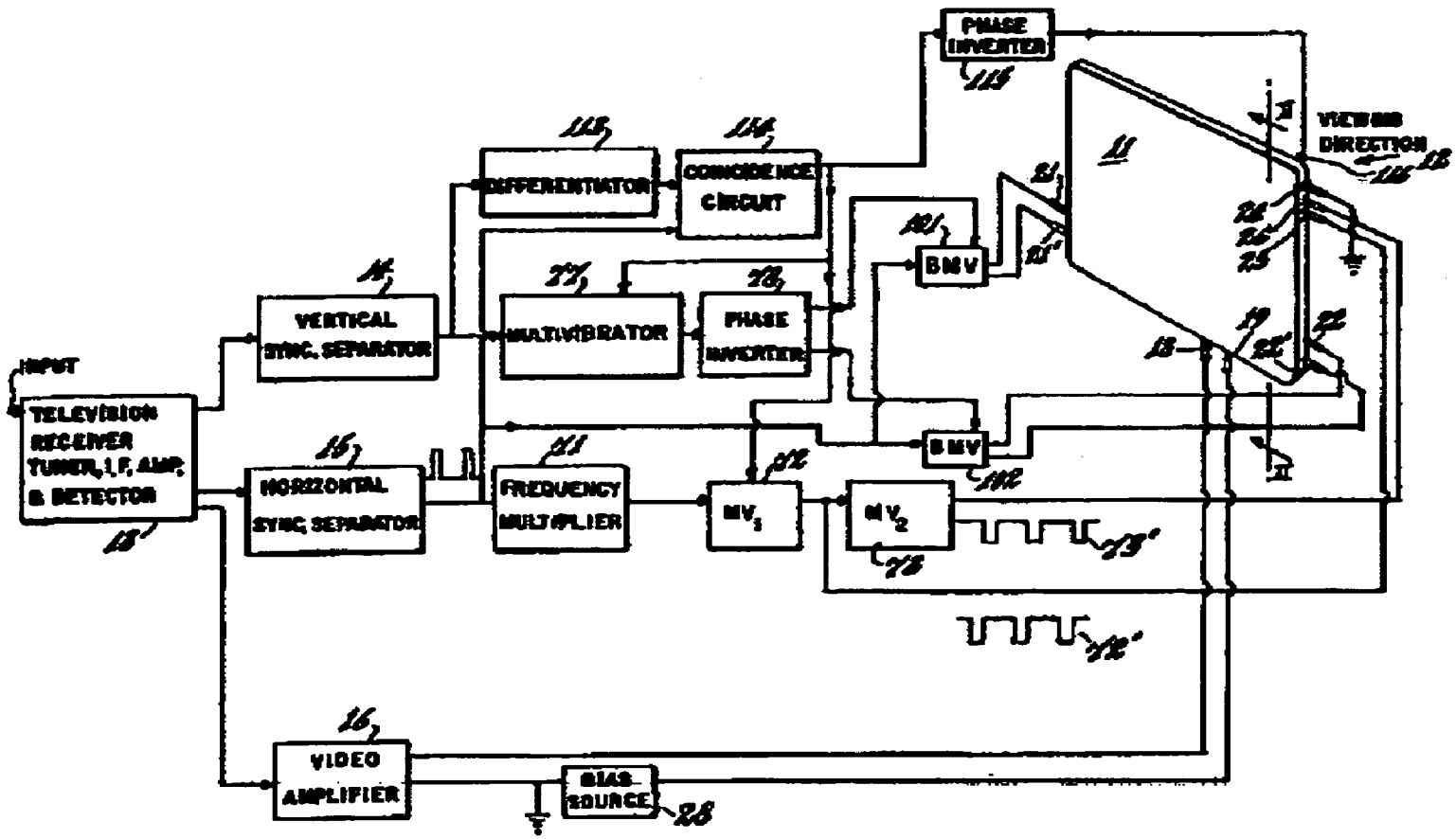
Fig. 6 Prior Art
FIG. 6 is a schematic diagram of the present invention applied to a television receiver.

FIG. 6 illustrates the prior art (Witmer, U.S. Pat) showing the electronic circuitry required to accomplish detection of incoming TV signals plus activation of the scanning electrodes including multivibrators, a vertical sync separator, horizontal sync separator, phase inverters, and the other electronic circuits required to meet the requirements of standard TV. For example, multivibrator coincidence circuit 114 controls the beginning of a complete frame scan. It initiates a positive potential to terminal 22" relative to terminal 21, FIG. 6, and causes bistable multivibrator 102 to be triggered to cause terminal 22 to be a maximum positive potential while terminal 22' is a much lower potential. By means of circuits such as this, well known in the television art, glow discharge electrodes may be selected and activated to accomplish the requirements of interlaced scanning.

Bistable multivibrators 101 and 102 (FIG. 6) are provided for generating the square wave voltages at one-half line frequency. For the duration of the first scan line, bistable multivibrator 102 maintains terminal 22 and the anode wires connected thereto (FIG. 3) positive relative to terminal 22' and the anode wires connected thereto relative to terminal 22' and the anode wires connected thereto. The starting phases for the system are initiated by a coincidence circuit 114 which is jointly responsive to the output of vertical sync pulse differentiator 113 and the sync pulses at the output of horizontal sync separator 15. The resultant output from coincidence circuit 114 is one pulse per frame of two fields, since, as in conventional line-interlaced television scan rasters, the differentiated leading edges of alternate ones of the vertical sync pulses are non-coincident with horizontal sync pulses.

The frame initiation pulse from the coincidence circuit 114 is also applied to a phase inverter 115 whose output is coupled to terminal 116 of the device 11, and thereby connected to a trigger probe adjacent cathode 51. The negative pulse thus applied establishes the initial glow discharge between cathode 51 and anode wire number 1.

The output of horizontal sync separator 15 is supplied to the input circuit of a frequency multiplier 71 which may comprise cascade stages providing multiplication by factors 4, 6 and 7, for example, the product of which is 168. Multiplier 71 receives pulses at horizontal line frequency f and produces output pulses at frequency 168f. These pulses are fed into Multivibrator 72, and a further multivibrator 73 is arranged to be triggered by the trailing edges of the pulses from multivibrator 72. The multivibrators 72 and 73 each produce rectangular output pulses of frequency 168f and of approximately 120o duration. Preferably, the output potential waves 72' and 73' from multivibrators 72 and 73 represent a change of potential from a substantially positive potential to a substantially negative potential during each pulse.

The outputs of multivibrators 72 and 73 are connected to terminals 25 and 26 of the device 11 (FIG. 5). The first negative pulse from multivibrator 72 makes the second vertical row of cathodes substantially more negative than the first and third rows, and attracts the glow discharge existing between cathode 51 and anode wire number 1. As a result, the glow discharge is caused to transfer to the adjacent cathode in the second vertical row which, like the first cathode 51, is adjacent to the number 1 anode wire. In turn, the ensuing negative pulse from multivibrator 73 causes the glow discharge to be attracted to the top cathode of the third vertical row. Upon cessation of that pulse, the glow discharge is yet further transferred to the top cathode of the fourth vertical row, since terminal 24 is maintained at sufficient negative potential to support the glow discharge at any cathode connected thereto and maintain it stationary awaiting a negative pulse from multivibrator 72. In this manner, the glow discharge is caused to proceed along a series of three cathodes for every cycle of the output of frequency multiplier 71.

One full line of cathodes may comprise 504 such elements. The extreme right-hand cathodes are each connected through a resistor to ground. In addition, a conductive path from each of the final cathodes in the direction of progression to the right extends to an auxiliary anode probe or trigger probe in the vicinity of the starting (left-hand) cathode for the next line to be scanned. Thus, cathode 71 at the right-hand end of the uppermost full horizontal line of cathodes, which is connected to a resistor having its opposite end grounded, is connected to the trigger probe extending adjacent to cathode 53. Upon the glow discharge progressing along the first (top) full line of cathodes and reaching cathode 71, the potential drop across the resistor connected thereto causes a rise in potential of the trigger probe adjacent cathode 53. Upon the commencement of the next half-cycle of wave E (FIG. 6), anode wires numbers 3 and 7 and every fourth wire below are raised to the potential for cooperating with the cathode array to sustain glow discharge, and the wires numbers 1, 5 and every fourth wire therebelow are so reduced in potential as to render them unable to participate in glow discharges. Upon this condition being provided, the glow discharge is enabled to progress along the cathodes adjacent anode wire number 3 (FIG. 3).

In like manner, the glow discharge is caused to progress to the right, its timing being regulated by the transmitter-synchronized timing of the horizontal sync pulses, and is again caused to be transferred from cathode 73 to the initial cathode 55 of the fifth full line of cathodes, etc.

Upon the glow discharge eventually reaching cathode 64, connected to resistor 64', the conductor extending from said cathode leads to a trigger probe for initiating glow discharge at cathode 50 in the top half-line of cathodes, adjacent anode wire number 0. The even-numbered cathode lines adjacent the even-numbered anode wires are then traversed for the second field of the scan raster during which the even-numbered anode wires are at higher potential than the odd-numbered anode wires.

The physical arrangement of the interconnections between the probes adjacent the right-hand cathodes and the transfer probes adjacent the left-hand cathodes to which the respective transfers are to be made is not shown. If desired, these paths may be provided on printed circuit layers which may be formed as part of the rear wall (FIG. 3) of the envelope, for example.

In system applications of the apparatus described herein, the speed of transfer of the electric glow discharge from cathode to cathode along a given scan line must be taken into account in determining the maximum value of the line scanning frequency f. If a 525-line scan picture is desired, with the number of elements in each horizontal line corresponding to a switching frequency of 168f, as mentioned in the foregoing example, then it is necessary for f to be such a frequency that $\frac{1}{504}f$ shall be no shorter than the minimum time for the glow transfer from one cathode to the next cathode.

The space within the thin viewing side frontplate (FIG. 1) and the backplate (FIG. 3), during the time of peripheral sealing is filled with a gas or gas mixture which preferably is selected for rapidity of initiation and extinction of gaseous glow discharge between a given pair of conductive elements. Such a gas, for example, may consist chiefly of hydrogen with a trace of krypton, maintained at a relatively high pressure, or it may be argon or xenon at high pressure to produce gaseous discharge in the arc region, or a gaseous metal halide may be used. Because of the construction method a gas pressure higher than atmospheric becomes possible and this is advantageous for increased lumens. Within the chosen gaseous medium the aforementioned luminous glow discharges are generated.

During the momentary existence of a glow discharge between one of the cathodes of the mosaic and the anode wire adjacent thereto, the immediate electrode cavity is illuminated and may be viewed through the transparent quartz window thus constituting a pixel element size source of light. Depending upon the gas therein and the voltage applied, variable light emission is possible. One way to use the pixel-sized light generating and scanning features of the invention described herein is to use a light amplifier over the light scanning apparatus. If an immediately adjacent layer of photoconductor is illuminated by the pixel-sized light glow, the resistivity of the photoconductor at this elemental area is momentarily sharply reduced in contrast to the relatively high resistivity between its parallel planar surfaces everywhere else. As a result, an electric current of intensity dependent upon the video potential difference momentarily impressed between the video input terminals 18 and 19 (FIG. 5) is caused to flow in the very localized region of an associated electroluminescent layer immediately in front of the momentary location of the glow discharge. Hence, that adjacent elemental area of the electroluminescent layer is caused to generate light output intensity directly dependent upon the potential difference momentarily existing between the video input terminals. While the same potential difference is applied over the entire surfaces of the substantially transparent conductive layers, the resulting current therebetween for energizing the electroluminescent layer at the given moment is substantially concentrated in the extremely small area of the photoconductive layer which is rendered substantially conductive by the glow discharge immediately to its rear.

An opaque high-resistivity layer between the photoconductive layer and the electroluminescent layer can serve as a barrier preventing the light generated in the electroluminescent layer from feeding back to tend to sustain a condition of high conductivity within the photoconductive layer. As well known in the art this opaque layer may be so thin as not to impede substantially the energizing current to the adjacent elemental area of the electroluminescent layer but is of sufficient resistivity to not distribute the energizing current over an appreciably broadened elemental area of the electroluminescent layer.

In view of the fact that the light pixel scanning in the present invention is much more precisely controlled as to time and position than in conventional cathode ray tubes, the present invention is especially adaptable to presentation of images in colors. By screen printing red, green and blue phosphors in the elemental areas of the picture screen different colors of luminescence can be generated. For example, along each scan line, in predetermined relation to the positioning of the cathodes along the line, by use of a transparent electrode such as tin oxide, and by modulating the video signal accordingly in timed relation to the scan, color images may be reproduced using methods well known in the art.

While a light amplifier or selected phosphors may be illuminated as described the light scanning device may also be used in conjunction with other associated display devices. For example the high intensity light pixel scanning plate could be used with a LCD panel to provide the bright illumination required of these devices. This not only reduces the electrical power required for total area backlighting but provides a scanned point light source meeting the requirements for television for LCD displays.

Construction

A preferred embodiment of the present invention is bonding of monocrystalline silicon to a glass viewing plate such as quartz, then the gas discharge pixel cavities are micromachined entirely through the silicon so that the pixel cavities become bottomed by the quartz. (Micromachining of silicon, as previously described, is formation of etched regions, or cavities, in a semiconductor crystal, usually silicon, using an etch-masking barrier such as silicon nitride). Each cavity so formed corresponds to a pixel element. One advantage of bonding the silicon to the glass is that this method allows sealing every individual cavity providing considerable increased faceplate strength. This is of considerable advantage when increased gas pressure is used to increase the luminous efficiency of each pixel element. Anodic bonding or a similar quartz (or glass)-to-silicon bonding method is used for sealing as well known in the MEMS art.

Another advantage of this inventive configuration is that an array of micropixel cavities requires conductive regions, metallic wires, and vias to carry electrical power to activate the gas discharge pixel elements. This complex, convoluted surface will necessarily be of complex topology and would normally obstruct viewing. In addition it is normally difficult to apply a hermetic package to such a convoluted surface. The novel disclosure herein has the desired result of allowing electrical interconnections to be formed on the side opposite the viewing surface. Thus the electrical conductor wiring may conveniently be applied to the back, non-viewing, surface of the device. By fabricating the interconnections on the surface opposite the viewing side structural fabrication requirements are greatly simplified and the viewing windows are completely unobstructed.

A double layer of silicon provides important advantages in formation of the tiny gas cavities. A particular embodiment is formation of the pixel cavities using an epitaxial silicon layer. It is well known in the semiconductor art that an epitaxial layer of dopant type opposite to the silicon substrate, or "body", can be used to control the depth of a micromachined cavity in silicon as described, for example, in Description of the Prior Art. This result can be used in a variation of the present disclosure. Since the thickness of the epitaxial silicon deposited onto the silicon body can be very precisely controlled in thickness, the depth of the cavity formed can be precision-controlled in depth by etching through the epitaxial layer wherein the bottom of the cavity is stopped by silicon of different etch rate. This procedure assures that a mirror smooth, flat-bottomed cavity at precision depth may be formed. This has very important advantages because minimum cavity width, controlled cavity depth, and self-alignment are very desired features to assure gas cavity uniformity especially when tiny gas cavities are of the order of 12 microns 12 millionth of a meter) in dimension. Another advantage is that hollow cathode structures can be fabricated by this method. FIG. 4 shows a hollow cathode structure with layer 3*a* only partially etched through. By means of the epitaxial structure described, a controlled thin opaque layer can be formed at the bottom of the gas discharge electrode cavity. This would be a very useful embodiment to achieve an infrared light scanning source, since the thin silicon layer at the bottom of the cavity is opaque to visible light but transmissive to IR light.

Another advantage of differing silicon layers is that the added silicon layer, either an epitaxial, diffused, or bonded layer can be of properties entirely different from the underlying silicon 'body' layer. It is well known in the art that silicon etches may be chosen that affect the rate of silicon dissolution depending on the properties of the silicon layer chosen. FIG. 4 shows silicon layer 3*a* added to silicon layer 3. A preferred embodiment is to make silicon layer 3 of $P^+$-type <100> crystal orientation, then use plasma etching to form cavity 2 in silicon layer 3 followed by KOH etching of $P^-$ type <100> crystal orientation, whereby silicon layer 3*a* can be etched to form enlarged cavity 17 using the much slower etching hole in layer 3 as etch mask. By this method cavities of differing sizes may be formed that are exactly coincident. These and other methods known in the MEMS art are used innovatively in the inventive structure to form self-aligned hollow cathode structures.

Gas discharges within hollow cavities provide increased current density and luminance, as described, for example, in *"Microhollow Cathode Discharges"*, Schoenbach, et. al, Appl. Phys, Lett 68 1, Jan. 1 '96). Electrode cavities micromachined in the novel layered silicon structure disclosed herein provide the desired characteristics of hollow cathodes.

Silicon/Quartz/Tungsten provides an ideal materials system for the gas cavity array because of the matched low coefficient of thermal expansion of silicon/quartz/tungsten. Therefore tungsten metallization is preferred for the gas discharge display electrode wiring. However tantalum, molybdenum or other refractory metal could be used. The melting point of silicon is very high, 1410° C., and tungsten is almost 2½ times higher, 3410° C. Quartz melts at 1665° C. The eutectics formed are also very important. The eutectic temperature of alloy formation of tungsten/silicon occurs at 1400° C. The electrical resistivity of tungsten provides excellent conductor properties, having about one-half the resistivity of platinum and substantially less resistivity than nickel. The thermal conductivity of silicon is good, better than that of nickel, and about equal to tungsten. The vapor pressure of all three materials and their combinations are extremely low at elevated temperatures.

One process embodiment begins with high resistivity, N-type, <100> silicon but the substrate could be any semiconductor of amorphic, epitaxial, polycrystalline, or single crystal form. The semiconductor can be in the form of a disk, slab, block or otherwise shaped object of single crystal, polycrystalline, or amorphous material. Moreover, the semiconductor can constitute the base material, or, in the alternative, can be CVD (Chemical Vapor Deposition) deposited onto a substrate material such as stainless steel, a ceramic such as alumina, or a glass such as quartz.

The preferred hermetic sealing procedure on the faceplate side is to first bond the silicon substrate using anodic bonding to a quartz or Pyrex plate. In this preferred embodiment the glass or quartz viewing side is hermetically sealed as a first process step. Hermetic sealing by anodic bonding is described, for example, by G. Wallis and D I Pomerantz, [Field-assisted glass-metal sealing, J. Appl. Phys, 40 (10) (1969) p 3946-3950], and in U.S. Pat. Nos. 3,397,278 and 3,417,459. Anodic bonding is selected as the bonding technique because such bonds are compatible with ultrahigh vacuum (UHV) and the gas backfilling required for long display life. The procedure is performed at low temperature and allows bonding to bare silicon surfaces or silicon surfaces with an oxide or silicon nitride film. Moreover, the cleaning of the two surfaces to be bonded is not as crucial as for other bonding techniques such as thermal bonding. Anodic bonding in its basic form is a combined thermal and electrostatic process. It can be performed on a hot plate at temperature between 180 and 5000C (well below the softening point of the Pyrex glass or quartz) in most gaseous atmospheres allowing desirable pixel element characteristics and protection, well known in the art. The process uses a d.c. voltage of typically 200 to 1,200 V. The glass needs to have a certain quantity of sodium cations, which act as charge carriers through the Pyrex or quartz because of their high mobility when the proper temperature is increased. Certain kinds of quartz have the required properties. Pyrex glass #7740 is often used rather than quartz because its expansion also matches that of silicon (ρ#7740)=2.9×10-6 K-1), (ρSi) =2.6 10-6 K-1), thus avoiding stress in the final structure after cooling.

The anodic bonding process begins by placing the polished quartz or Pyrex wafer in alignment against the polished silicon wafer. Then this sandwich is heated on a hot plate while a negative d.c. voltage is applied to the top of the quartz viewing plate (or Pyrex wafer), using an electrode in intimate contact. The positive side of the d. c. voltage is applied to the electrode (metal hot plate) on the silicon wafer side. At application of the electric field the Na+ ions in the quartz or Pyrex glass start drifting to the cathode, neutralizing the cathode while creating a depletion zone in the glass adjacent to the silicon anode. This depletion zone, which has a thickness of less than 1 μm in the beginning, can be compared with a capacitor that is being charged. During this charging process, the electric field is high enough to allow a drift of oxygen anions to the anode where they react with the silicon anode, creating a silicon-oxygen bond. The depletion zone is created because the mobility of cations (small ions) is higher than that of the anions (large ions). Subsequently, the depleted zone becomes larger and the current smaller. The high electric field in this area creates a strong electrostatic force, acting on the two surfaces and effectively pulling them together thus forming an intimate contact. This intimate contact allows the two surfaces to react chemically and the bond is formed. Other state-of-the-art bonding processes may be also be used for the bonding operation. The overall advantage at the end of the process procedure, after the pixel cavities are etched, is that the pixel elements are individually bonded to the faceplate thus greatly increasing the overall faceplate strength and isolating each gas cavity.

To form the pixel cavities the process begins by forming a protective layer of SiO2 and/or Si3N4 on the non-bonded silicon surface, as well known in the art. This protective layer is selectively etched away using photolithographic procedures so as to form a pattern to permit the etch formation of pixel cavities shown in FIG. 1. A main advantage of the photolithographic process, regarding the array of pixel cavities, is that the complexity of the array and subsequent metal conductive patterns are set by the artwork. Photolithographic processes are highly developed in the microelectronics industry and can presently fabricate etched lines having widths of less than one micron, in extraordinarily complex patterns. Consequently any pixel element cavity pattern which can be artwork designed can easily be formed, greatly facilitating fabrication.

By the present disclosure, cavity formation is accomplished using the patterned micropixel array pattern as the micromachining mask. The preferred silicon material is crystalline of <100> orientation and the preferred etch is concentrated KOH heated to 85° C. KOH will anisotropically etch <100> silicon, much more quickly etching the <100> layers and very slowly etching in the <111> crystal direction. A preferred mixture of the KOH etch is; 50 g KOH, 40 g propanol, and 160 g $H_2O$. This KOH etchant forms a cavity in <100> silicon with an edge slope of 54.7 degrees. The two planes corresponding to the two parallel edges of the etch window define a cavity with depth equal to the thickness of the silicon wafer and the cavity may be bottomed by the quartz viewing plate.

To form the column electrodes shown in FIG. 1 a thin layer of SiO2, about 1,000 Angstroms thick is CVD deposited onto the silicon wafer side and portions are removed photolithographically, corresponding to the required conductor patterns. The silicon wafer is next exposed to tungsten hexafluoride gas or other suitable halogenated refractory metal gas heated to a temperature of between 250° C. and 500° C. so as to form a layer of tungsten or other refractory metal in/on the exposed silicon by means of selective chemical reduction. For tungsten this very low temperature reaction is the chemical equation described as follows:

$$2WF6+3Si \rightarrow 2W+3SiF4$$

This initial reaction actually produces a very thin underlayer of tungsten silicide beneath the tungsten. This tungsten silicide interface layer is chemically described as WSi2. The total thickness of the reacted layer is about 200-500 Angstroms. Very pure tungsten is formed by this self-limiting chemical reaction if the reaction gas is pure. Thicker tungsten deposit may be formed by adding hydrogen to the gas on a controlled basis until the tungsten thickness is at the thickness desired. Further, because the reaction is specific to silicon, no tungsten deposits on adjacent SiO2 surfaces; hence, the tungsten conductor line deposits "selectively" and self-aligns on the exposed silicon. Moreover, because approximately 20-50 atomic layers of silicon are removed during the process, the silicon on which the tungsten is deposited is virgin material, and together with the selective nature of the reaction, a self-limiting deposit of tungsten is obtained which exhibits excellent adhesion, reproducible contact and bulk resistance, excellent scratch resistance, and the other characteristics required for the ideal gas discharge electrode connectors required for the structured show in FIG. 1. By the nature of the chemical reaction the tungsten formed is conformal with the substrate topology. This means, for example, that the silicon could be first anisotropically etched to form the desired pixel element pattern, then the hexafluoride gas reacted with the exposed silicon to form the electrodes in the pixel cavities plus forming the connecting column connectors. By this method columnar cathode conductor patterns may be formed on the convoluted cavity array 1.

Because the resistivity of pure tungsten film is in the range of 10-15 μohm-cm, the total resistance of the conductor patterns can be easily determined. By the process described the column conductors become an integral part of the semiconductor at the surface. Other refractory materials might be used as conductors for the plasma display device. These materials include the refractory metals tantalum, platinum, palladium, molybdenum, zirconium, titanium, nickel, chromium, or the suicides of these materials, and/or desired combinations. Titanium may be deposited as a secondary conductor material whereby it is used to 'getter' gases from the internal ambient in the finished hermetic package.

The non-viewing side of the display assembly (FIG. 3) is a plate of ceramic or other suitable material onto which row electrodes are evaporated or sputtered to match the pixel element configuration. A suitable metallic material patterned for these electrodes is chrome-gold or other well known metallic conductor electrode materials that adhere to ceramics.

After the electrode cavities are micromachined in the silicon layer and the electrodes and interconnections have been formed the plasma flat panel display is hermetically sealed by attaching the frontplate (FIG. 1) to the backplate (FIG. 3). This is performed while the desired gas filler such as pressurized hydrogen, mercury, xenon, argon, sodium or metal halides, or some combination thereof, is present. The plates are bonded together at the periphery using a state-of-the-art microelectronic bonding technique, such as low temperature alloy sealing, or glass frit sealing. Davidson, U.S. Pat. No. 4,563,617, teaches use of a faceplate attached around the mutual perimeter of a substrate assembly to provide a hermetic enclosure. This procedure could be used to seal the non-viewing side of the device in a preferred gas. Horstey et. al., (U.S. Pat. No. 4,095,876) describes a metal coated around the periphery of a display panel and added soldering for bonding. Dabral (U.S. Pat. No. 5,781,858) describes a similar metalized hermetic sealing method.

To eliminate bulb blackening and for redepositing evaporated W back onto thin spots of the electrodes, bromotrifluoromethane (CBrF3) is a recommended gas additive. This gas ambient additive allows the fluoride component to aid redeposit of the tungsten back onto hot spots on the electrodes thus providing a "self-healing" action. In addition the C component reacts with oxygen in the enclosure forming a stable compound of CO2 tying up any residual oxygen in the hermetic enclosure. (See, for example, "Chemical equilibrium calculations of tungsten-halogen systems", (J. A. Sell, J. Appl. Physics, 54 (8) Aug. 1983, p4605-4813).

The invention disclosed describes a method to achieve gas discharge pixel raster scanning as required for TV for a miniature plasma display by use of innovative fabrication methods based on integrated circuit and MEMS fabrication technology. While the invention has been described in preferred embodiments, it is to be understood that the words which have been used are words of description rather than limitation and that changes within the purview of the appended claims may be made without departing from the true scope of the invention as defined by the claims. Although specific embodiments of the invention have been shown and described, it will be understood that they are but illustrative and that various modifications may be made therein without departing from the scope and spirit of this invention.

What I claim:

1. A mini plasma display, comprising in combination:

(a) semiconductor substrate, (b) gas containment cavity array formed in said semiconductor substrate, (c) ionization slots each cavity in row direction wherein said ionization slots allow sustained glow discharge at activated gas cavity extending ionization to immediately preceding and immediately succeeding cavities in the row therein, (d) columnar electrodes interconnecting gas cavities in groups, (e) row electrodes orthogonal to columnar electrodes interconnecting gas cavities in groups, (f) hermetic sealing and gas filling means, (g) pulsed electronic circuit enabling means providing electrical activation of selected column and selected row electrodes wherein luminous glow discharge is established in gas containment cavity at crossover of said electrodes for start of frame period of video raster scan wherein electrical activation of said luminous glow discharge is triggered in timed relation to standard television broadcast signals, (h) pulsed electronic circuit enabling means providing electrical activation of selected column electrode groups and selected row electrode groups imparting sequential bistable transfer of an established luminous glow discharge along a row triggered in timed relation to standard television broadcast signals, (i) pulsed electronic circuit enabling means providing electrical activation of selected column electrode groups and selected row electrode groups providing synchronized electrical activation of frame initiation and luminous glow discharge scan transfer along a row triggered in timed relation to standard television broadcast signals, wherein the improvement is a method for eliminating orthogonal X-Y addressing as well as improved structure for the construction of a mini display panel of the plasma type.

2. A mini plasma display of claim 1 containing additionally a transparent faceplate sealed to said semiconductor substrate, wherein the improvement is improved viewing of luminous glow discharge on transparent faceplate side unobstructed by operational electrodes plus increased structural strength of gas containment cavities sealed in full peripheral extant allowing increased gas pressure and thus increased lumens in a plasma display of the mini type.

3. A mini plasma display of claim 2 wherein said semiconductor substrate is anodically bonded to said transparent viewing faceplate.

4. A mini plasma display panel of claim 1 containing semiconductor substrate consisting of at least two layers differing in etch rate properties wherein cavity array pattern etched in top semiconductor layer is used as etch mask to define gas cavity array in underlying semiconductor layer thereby forming cavities thereunder contingent to and self-aligned with top layer cavities, wherein the improvement is a method for achieving concentric gas cavity structures.

5. A mini plasma display of claim 1 containing semiconductor substrate consisting of at least two layers differing in etch rate properties whereby the respective etch rates each layer control the dimensional size and therefore volume of gas cavity so formed in respective layers, wherein the improvement is a method for achieving hollow cathode structures for enhanced glow discharge luminosity.

6. A mini plasma display of claim 1 containing semiconductor substrate consisting of at least two layers differing in etch rate properties whereby the etch rate of top layer after formation of gas cavity array is low compared to higher etch rate of underlying layer whereby the dimensional size and therefore volume of underlayer gas cavities so formed may be made larger than top layer cavities, wherein the improvement is a method for achieving hollow cathode structures for enhanced glow discharge luminosity.

7. A mini plasma display of claim 1 containing semiconductor substrate consisting of at least two layers differing in etch rate properties whereby the etch rate of top layer after formation of gas cavity array is high compared to lower etch rate of underlying layer wherein the dimensional size and therefore volume of underlayer gas cavities so formed may be made smaller than top layer cavities, wherein the improvement is a method for achieving hollow cathode structures for enhanced glow discharge luminosity.

8. A mini plasma display panel of claim 1 wherein cavities formed in first layer are bottomed by second semiconductor layer of very low etch rate on transparent viewing side wherein said semiconductor layer or portion thereof on transparent faceplate side is left intact as opaque to visible light, thereby providing desirable flat-bottomed gas cavities of precise dimensions for an improved IR display.

9. The mini plasma display panel of claim 8 wherein top semiconductor layer of selected crystal orientation is doped P-type and bottom semiconductor layer of selected crystal orientation is doped N-type providing hollow cavities by chemical etching of enhanced dimensional extent on transparent viewing plate side to allow hollow cathode structures of increased lumens.

10. The mini plasma display panel of claim 8 wherein top semiconductor layer of selected crystal orientation is doped N-type and bottom semiconductor layer of selected crystal orientation is doped P-type providing hollow cavities by chemical etching of reduced dimensional extent on transparent viewing plate side to allow hollow cathode structures of increased lumens.

11. A mini plasma display of claim 1 wherein said semiconductor substrate is silicon of selected crystal orientation.

12. A mini plasma display of claim 1 wherein said semiconductor substrate is silicon of <100> crystal orientation.

13. The mini plasma display of claim 1 further including at each pixel element transparent electrodes for activation of selected color phosphors whereby signal activation in scanned synchronism with luminous gaseous discharge of phosphors at selected pixel elements provides light and color values in correspondence with supplied television signal means, thereby providing color rendition of television with increased lumens by hollow cathode design plus increased gas pressure with viewing unobstructed by control electrodes by a method of low cost construction and wherein the scanned gas discharge light pixels of increased lumens may be used as a robust, small-sized, thin, high pixel density, high resolution television display.

14. The mini plasma display of claim 1 cooperatively providing a scanning lighting source of recurring raster pattern for a LCD display.

* * * * *